US008656549B2

(12) United States Patent
Watters

(10) Patent No.: US 8,656,549 B2
(45) Date of Patent: Feb. 25, 2014

(54) DRYWALL KNIFE WITH BRACE

(75) Inventor: Ronald S. Watters, Faribault, MN (US)

(73) Assignee: Watters & Lockman, LLC, Rio Rancho, NM (US)

( * ) Notice: Subject to any disclaimer, the term of this patent is extended or adjusted under 35 U.S.C. 154(b) by 194 days.

(21) Appl. No.: 13/087,150

(22) Filed: Apr. 14, 2011

(65) Prior Publication Data

US 2012/0260448 A1 Oct. 18, 2012

(51) Int. Cl.
*B05C 17/10* (2006.01)

(52) U.S. Cl.
USPC ..... 15/245.1; 15/235.4

(58) Field of Classification Search
USPC ..... 15/245.1, 235.8, 235.4, 235.5, 235.6, 15/236.01, 236.05
See application file for complete search history.

(56) References Cited

U.S. PATENT DOCUMENTS

| | | | | |
|---|---|---|---|---|
| 952,971 | A | 3/1910 | Wolary | |
| 1,067,301 | A | 7/1913 | Bricker | |
| 1,083,099 | A | 12/1913 | Howg | |
| 1,201,076 | A | 10/1916 | Murray | |
| 1,306,135 | A | 6/1919 | Bricker | |
| 1,413,441 | A | 4/1922 | Wenger | |
| 1,681,082 | A | 8/1928 | Bamberger | |
| 1,743,704 | A | 1/1930 | Boux | |
| 2,689,369 | A | 9/1954 | Biek | |
| 2,725,740 | A | 12/1955 | Borgstrom | |
| 2,800,672 | A | 7/1957 | Gilyan | |
| 3,069,713 | A | 12/1962 | Obraske | |
| 3,123,947 | A | 3/1964 | Rawley | |
| 3,878,581 | A | 4/1975 | Perna | |
| 4,339,838 | A | 7/1982 | Pekarek | |
| 4,495,668 | A | 1/1985 | Adams | |
| 4,654,919 | A | 4/1987 | Liberman | |
| 4,731,258 | A | 3/1988 | Liberman | |
| 4,946,360 | A | 8/1990 | Brown | |
| D323,271 | S | 1/1992 | Barenthsen | |
| 5,192,558 | A | 3/1993 | Sparrow et al. | |
| 5,261,144 | A | 11/1993 | Mitchell et al. | |
| 5,351,357 | A | 10/1994 | Liberman | |
| 5,440,776 | A | 8/1995 | Kartler | |
| 5,655,248 | A | 8/1997 | Kieson et al. | |
| 5,664,280 | A | 9/1997 | Tonsager | |
| 5,737,795 | A | 4/1998 | Murders | |
| 5,759,590 | A | 6/1998 | Cacossa | |
| 5,774,924 | A | 7/1998 | Beckham et al. | |
| 6,595,764 | B1 | 7/2003 | Volk | |
| 7,048,618 | B1 | 5/2006 | Cramer | |
| 7,698,774 | B1 * | 4/2010 | Coon | 15/235.8 |

(Continued)

FOREIGN PATENT DOCUMENTS

| | | |
|---|---|---|
| DE | 1092816 | 11/1960 |

*Primary Examiner* — Shay Karls
(74) *Attorney, Agent, or Firm* — Winthrop & Weinstine, P.A.

(57) ABSTRACT

A drywall knife with a retractable brace is disclosed. The knife comprises a handle; a substantially planar, flexible blade hingedly attached to the handle; and a brace having a cross-member wherein the brace is attached to the handle and wherein the cross-member defines at least one substantially non-linear profile wherein the cross-member substantially imparts a substantially non-linear profile to the blade. The knife may further comprise the cross-member defining two or more substantially non-linear or arcuate profiles, and the cross-member may be positionable to substantially impart different non-linear profiles selectively to the blade. The cross-member may further define knobby contact surfaces contactable with the blade. The brace may be substantially T-shaped, and the brace may be retractable.

11 Claims, 6 Drawing Sheets

(56) References Cited

U.S. PATENT DOCUMENTS

| | | | |
|---|---|---|---|
| 7,725,982 | B2 | 6/2010 | Hoch |
| 7,752,703 | B1 | 7/2010 | Silva |
| 2004/0226126 | A1 | 11/2004 | Cox et al. |
| 2007/0056133 | A1 | 3/2007 | Pyatt et al. |
| 2009/0178224 | A1 | 7/2009 | Fronek |

* cited by examiner

DRYWALL KNIFE WITH BRACE

BACKGROUND

The field of the invention is drywall knives.

The art of applying drywall compound or "mud" to a taped drywall joint is highly specialized, often requiring months or years of practice to perfect. The drywall knife disclosed herein simplifies the process of mudding drywall joints.

SUMMARY

One embodiment of the present drywall knife comprises a handle; a substantially planar, flexible blade attached to the handle; and a brace having a cross-member wherein the brace is attached to the handle and wherein the cross-member defines at least one substantially non-linear profile and imparts a substantially non-linear profile to the blade. The knife may further comprise the cross-member defining two or more substantially non-linear profiles, and the cross-member may be positionable to substantially impart different non-linear profiles selectively to the blade. The brace may be substantially T-shaped, and the brace may be retractable.

In another embodiment, a drywall knife comprises a handle; a channel disposed within the handle; a substantially planar, flexible blade attached to the handle; and a T-shaped brace having a central post and a cross-member wherein the central post is slidably disposed within the channel of the handle and wherein the cross-member defines at least one profile wherein the blade is biased to rest against the cross-member such that the cross-member substantially imparts a profile to the blade. The profile imparted to the blade may be substantially non-linear, and the profile imparted to the blade may be substantially arcuate. Further, the cross-member may define at least two profiles, and the cross-member may be positionable to substantially impart different profiles selectively to the blade. The cross-member may further define knobby contact surfaces contactable with the blade. In addition, the blade may be hingedly attached to the handle, a tab may be attached to the blade, and a spring may be disposed between the tab and the handle.

In yet another embodiment, a drywall knife comprises a handle; a channel disposed within the handle; a substantially planar, flexible blade hingedly attached to the handle; and a retractable T-shaped brace having a central post and a cross-member wherein the central post is slidably disposed within the channel of the handle, wherein the cross-member defines two or more substantially non-linear profiles, and wherein the blade is biased to rest against the cross-member such that the cross-member substantially imparts one of two or more substantially arcuate profiles to the blade. The cross-member may further define three substantially non-linear profiles.

DETAILED DESCRIPTION

Figure 1:
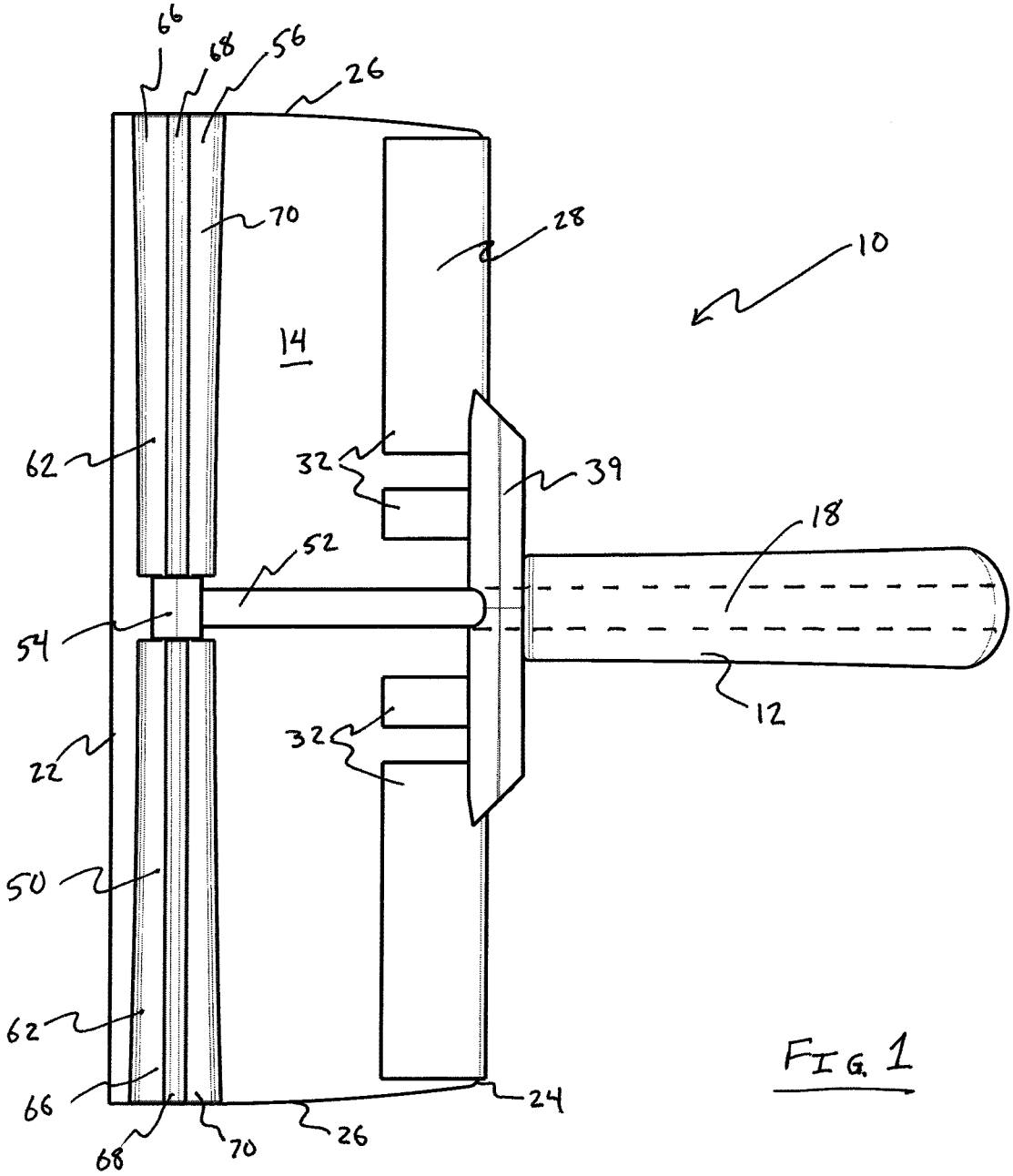
FIG. 1 is a top planform view of an embodiment of a drywall knife with a brace.
Figure 2:
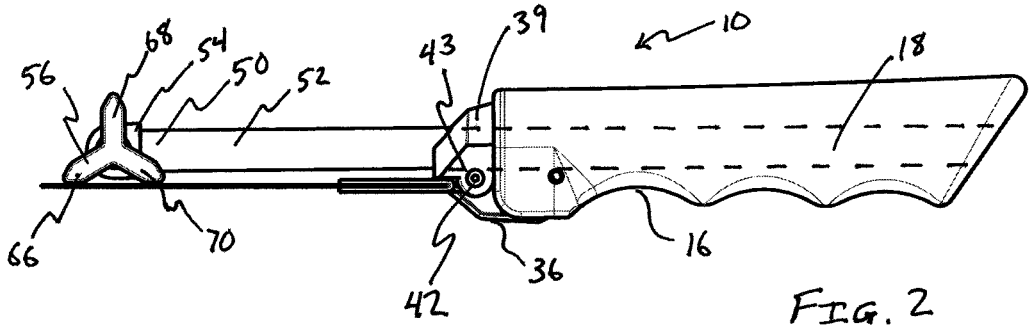
FIG. 2 is a side elevational view of an embodiment of a drywall knife with a brace.
Figure 3:
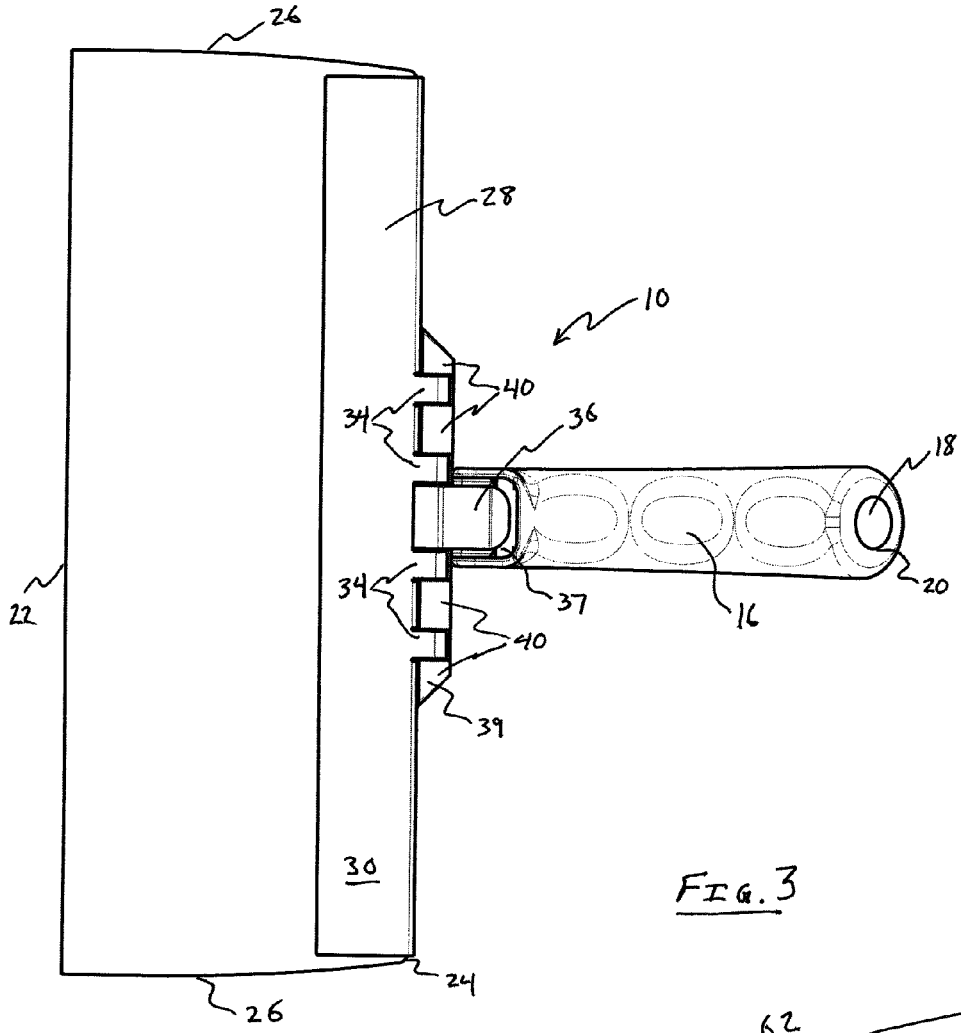
FIG. 3 is a bottom planform view of an embodiment of a drywall knife with a brace.

FIG. 1 shows a top planform view of a drywall knife 10. The knife 10 has a handle 12 and a substantially planar, flexible blade 14 attached to the handle 12. As shown in the drawing figures, the handle 12 has a generally cylindrical shape that is somewhat tapered, with the narrower end nearer to the blade 14 and the wider end away from the blade 14, although the handle 12 may have any shape or size capable of being held by a human hand (not shown). As shown in FIG. 2, a side elevational view of the knife 10, and in FIG. 3, a bottom planform view of the knife 10, the handle 12 may have one or more curved portions 16 suitable for receiving one or more fingers of a hand when gripping the handle 12. The handle 12 may also be constructed or formed so as to define a channel 18 running substantially longitudinally through the handle 12. The channel 18 may terminate with an aperture 20 formed at the end of the handle 12 distal to the blade 14. The handle 12 may be constructed from any suitable material.

The blade 14 of the knife 10 is substantially planar and is substantially rectangular or trapezoidal in shape, defining a leading edge 22, a rear edge 24, and side edges 26. The blade 14 may be made from any flexible material, however metal is likely to provide a longer service life for the blade, and steel or steel alloys are likely to produce blades with both suitable flexibility and longevity. Different embodiments of the knife 10 may be made with blades having differing sizes and stiffnesses, depending upon the intended application for each embodiment of the knife 10. The size may vary in both overall planform area, as well as thickness.

Figure 10:
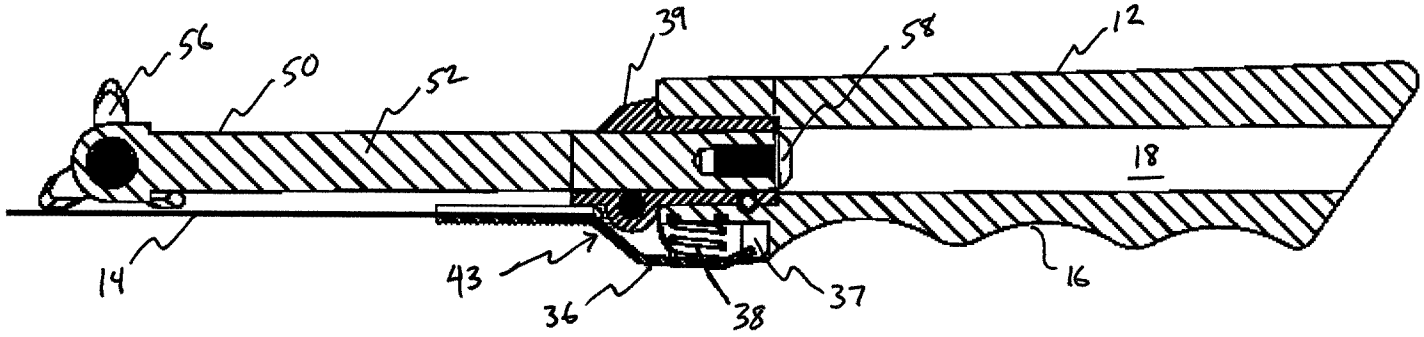
FIG. 10 is a cut-away side elevational view of an embodiment of a drywall knife with a brace.
Figure 11:
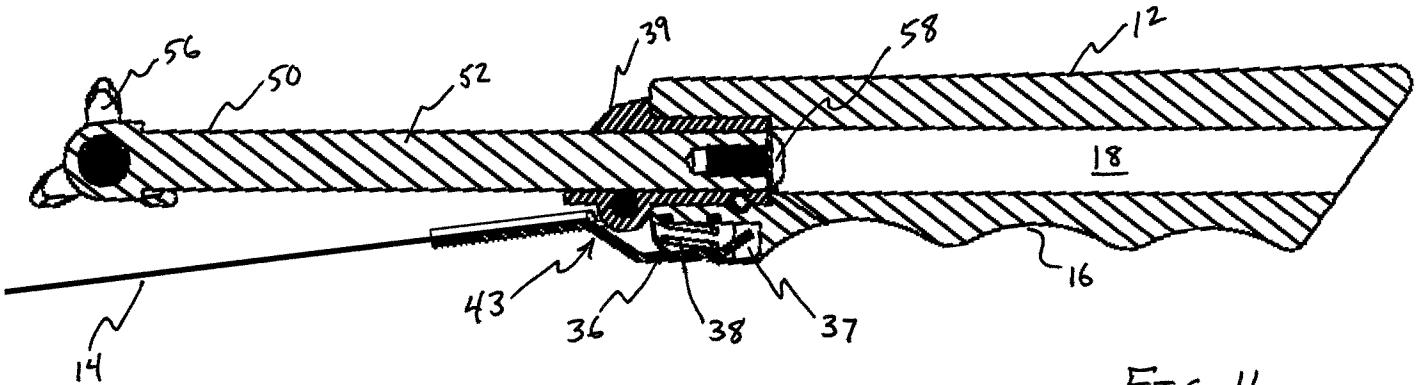
FIG. 11 is a cut-away side elevational view of an embodiment of a drywall knife with a brace.
Figure 12:
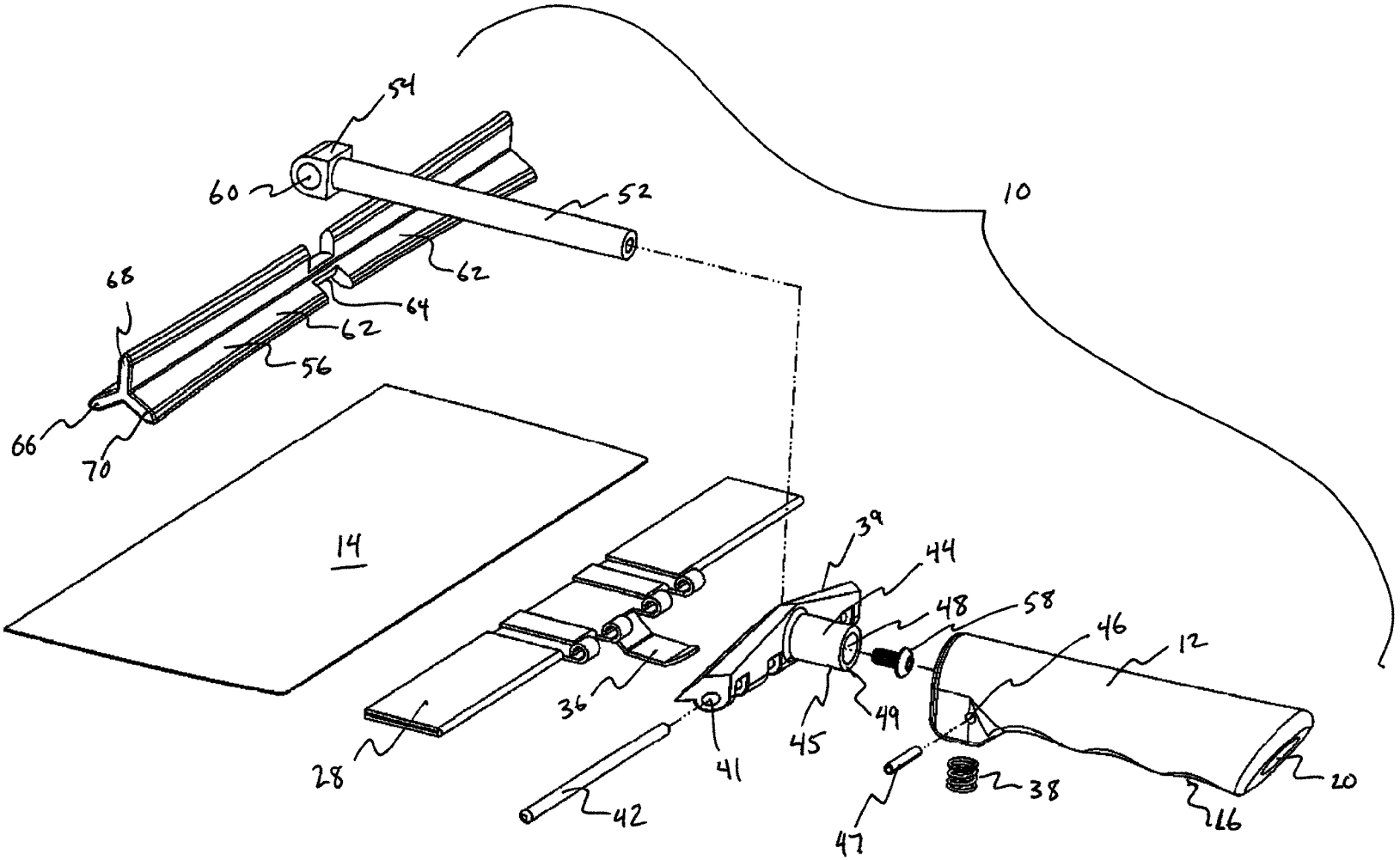
FIG. 12 is an exploded perspective view of an embodiment of a drywall knife with a brace.

The rear edge 24 of the blade 14 may be stiffened or reinforced by a reinforcing member 28. The reinforcing member 28 may comprise a single piece of material formed to wrap around the rear edge 24 of the blade 14 to define a bottom reinforcing element 30 and top reinforcing elements 32. Portions of the reinforcing member 28 may also be formed to comprise one or more hinge portions 34. In some embodiments, the reinforcing member 28 may also be formed to define a tab 36 that extends over a recessed portion 37 of the handle 12. A spring 38 may be disposed between the tab 36 and the recessed portion 37 of the handle 12 as shown in FIGS. 10, 11, and 12. The reinforcing member 28 may be made from metal or other suitable material. In some embodiments, the reinforcing member 28 may be comprised of multiple pieces of material.

In reference to FIGS. 1, 2, 3, and 12, the knife 10 also has a hinge carrier 39 with hinge portions 40. The hinge portions 40 of the hinge carrier 39 are interlaced with the hinge portions 34 of the reinforcing member 28 to define a substantially tubular hinge channel or axis 41 through which a pin 42 may be inserted to establish a hinged connection 43 between the hinge carrier 39 and the reinforcing member 28. The hinge carrier 39 also defines a collar 44 sized to fit within the handle 12. The collar 44 may have a notch or hole 45 that aligns with a hole 46 in the handle 12 through which a pin 47 may be inserted to affix the hinge carrier 39 to the handle 12. Alternatively, the collar 44 and the handle 12 may be attached in any suitable way, including, without limitation, overmolding or a threaded or friction-fit connection. The hinge carrier 39 and collar 44 further define a channel 48 substantially in axial alignment with the channel 18 in the handle 12. The collar 44 also further defines a shoulder 49.

The knife 10 also has a brace 50 having a central post 52, a hub 54, and a cross-member 56. The central post 52 is substantially rigid and substantially cylindrical in shape, although it may be formed in any suitable shape, and it is sized to be slidably disposed within the channel 48 of the hinge carrier 39 and collar 44. A stop 58 may be attached to the end of the post 52 disposed within the channel 48 in order to limit the forward travel of the post 52 outside of the handle 12 by interfering with the shoulder 49 on the collar 44. The hub 54 is connected to the end of the post 52 located away from the handle 12, and may be integrally formed with the post 52 or may be separately formed and then attached to the post 52 by suitable means. The hub 54 also defines a bore 60.

Figure 4:
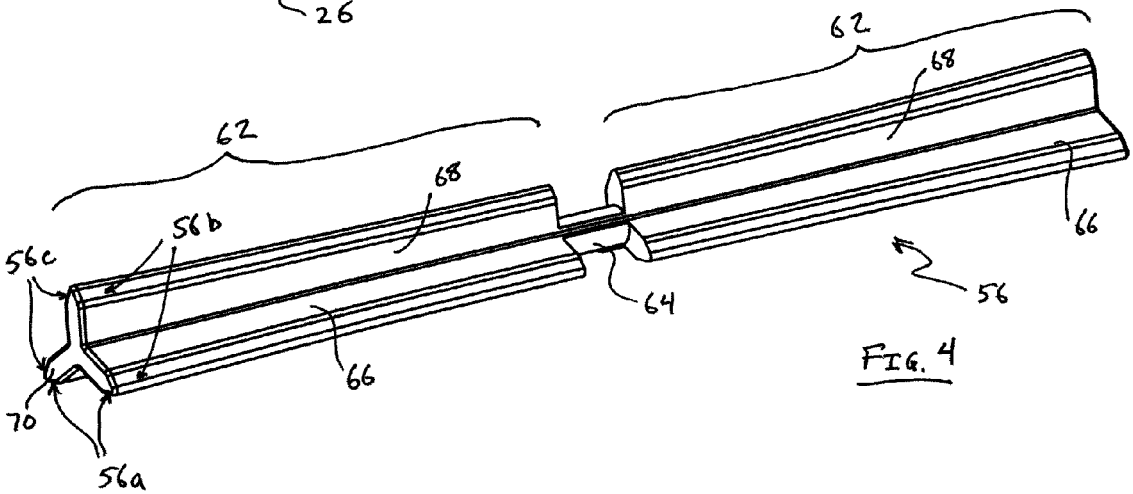
FIG. 4 is a perspective view of an embodiment of a cross-member for a brace for use with a drywall knife.

As shown in FIGS. 1, 2, and 4, the cross-member 56 has two arms 62 connected by a substantially cylindrical central portion 64 disposed through the bore 60 in the hub 54. The central portion 64 and bore 60 are sized so that the cross-member 56 and central portion 64 are free to rotate within the hub 54. The arms 62 of the cross-member 56 each have longitudinal lobes 66, 68, and 70. The lobes 66, 68, and 70 also define contact surfaces 56*a*, 56*b*, and 56*c*. Contact surfaces 56*a* are formed from adjacent longitudinal lobes 66 and 70 such that when the cross-member 56 is positioned such that longitudinal lobes 66 and 70 are in contact with the blade 14, contact surfaces 56*a* are positioned immediately adjacent to the blade 14. Similarly, when adjacent longitudinal lobes 66 and 68 are in contact with the blade 14, contact surfaces 56*b* are positioned immediate adjacent to the blade 14. Finally, when adjacent longitudinal lobes 68 and 70 are in contact with the blade 14, contact surfaces 56*c* are positioned immediate adjacent to the blade 14.

Figure 5:
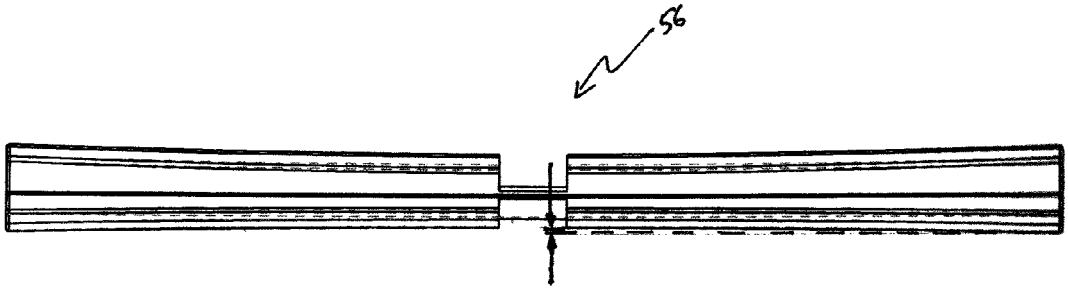
FIG. 5 is a front elevational view of an embodiment of a cross-member for a brace for use with a drywall knife.
Figure 6:
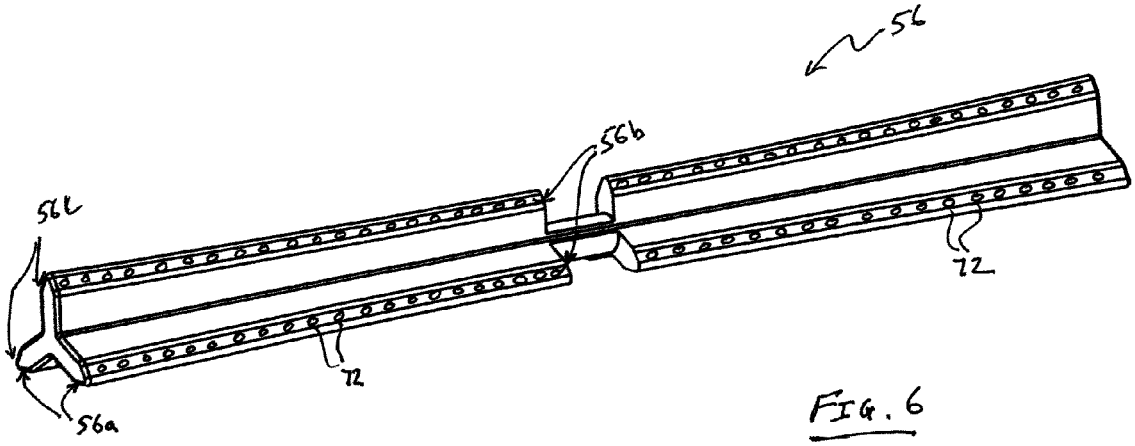
FIG. 6 is a perspective view of an embodiment of a cross-member for a brace for use with a drywall knife.

In one embodiment, the arms 62 of the cross-member 56 are tapered in such a way that the portions of the contact surfaces 56*a* nearest the central portion are not co-planar with the portions of the contact surfaces nearest the ends of the outer ends of the arms 62. The contact surfaces 56*a* may thus define a non-linear profile when viewed in elevation as depicted in FIG. 5, and in some embodiments, the contact surfaces 56*a* may define a substantially arcuate profile (not shown). Similarly, in one embodiment, contact surfaces 56*b* and 56*c* are similarly formed to define non-linear profiles when viewed in elevation, and in some embodiments, contact surfaces 56*b* and 56*c* may define substantially arcuate profiles. In one embodiment, each of contact surfaces 56*a*, 56*b*, and 56*c* define a different profile. Further, in some embodiments, one of the contact surfaces 56*a*, 56*b*, and 56*c* may instead define a substantially planar profile. In some embodiments, as in those shown in FIGS. 1, 2, 4, and 5, the contact surfaces 56*a*, 56*b*, and 56*c* are substantially smooth. In other embodiments, as shown in FIG. 6, one or more of contact surfaces 56*a*, 56*b*, and 56*c* may be formed to define one or more substantially rounded bumps or knobs 72.

Figure 7:
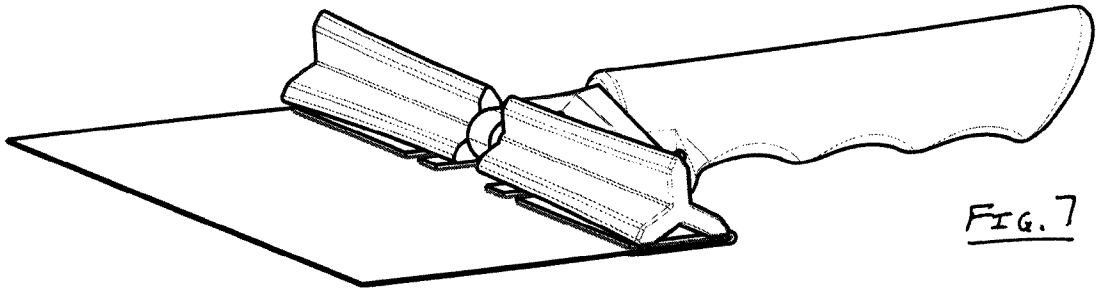
FIG. 7 is a perspective view of an embodiment of a drywall knife with a brace in a retracted position.

As shown in FIG. 7, the knife 10 may be operated with the brace 50 and cross-member 56 in a refracted position, in which the central post 52 of the brace is substantially retracted into the channel 18 in the handle 12 such that the cross-member 56 abuts the hinge carrier 39 and rests adjacent to the top reinforcing elements 32 of the reinforcing member 28.

Figure 8:
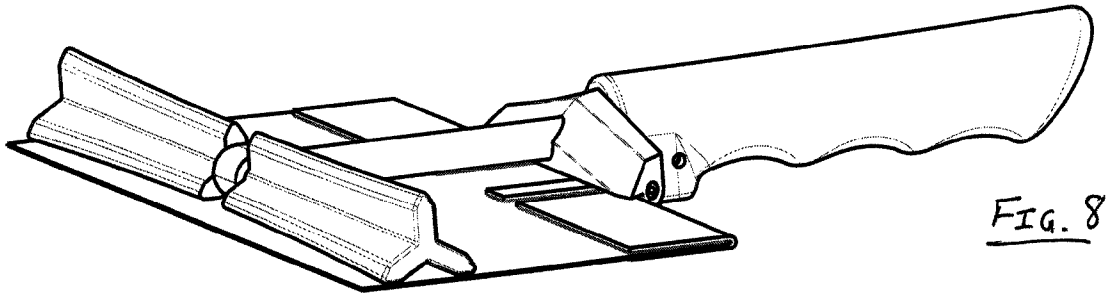
FIG. 8 is a perspective view of an embodiment of a drywall knife with a brace in an extended position.

As shown in FIGS. 8 and 10, the knife 10 may be operated with the brace 50 and cross-member 56 in a fully extended position, in which the stop 58 abuts the shoulder 49 of the collar 44 of the hinge carrier 39. In this position, the cross-member 56 rests against the blade 14 near its leading edge 22. Viewing FIG. 8 in connection with FIG. 10, a cut-away side elevation view of the knife 10, the spring 38 is in compression between the tab 36 and the recessed portion of the handle 12. Because the tab 36 is attached to the reinforcing member 28 and the blade 14, the blade is biased against the contact surfaces 56*a* of the cross-member 56. In embodiments where the contact surfaces 56*a* of the cross-member 56 substantially define a non-linear profile, when the knife 10 is drawn with sufficient force across one or more pieces of drywall (not shown) on which drywall compound (not shown) has been spread, the leading edge 22 of the flexible blade 14 of the knife 10 will impart a substantially non-linear profile to the drywall compound in what is known as a "feathered" application.

In addition to the refracted configuration of the brace 50 as shown in FIG. 7 and the fully extended configuration of the brace 50 as shown in FIGS. 8 and 10, the knife 10 may be operated with the brace 50 in any position between these extremes. In some embodiments, it may be desirable to remove the brace 50 altogether and use the knife 10 without the brace 50.

Figure 9:
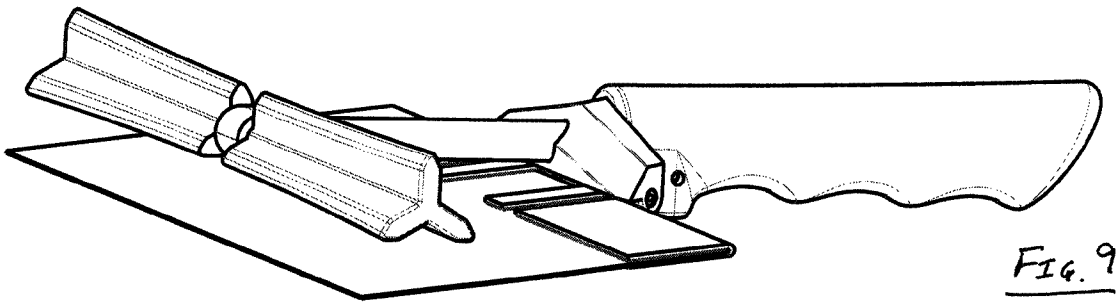
FIG. 9 is a perspective view of an embodiment of a drywall knife with a brace.

In order to change the position of the brace 50, a user depresses the tab 36 on the reinforcing member 28 into the recessed portion 37 of the handle 12, thereby compressing the spring 38, as shown in FIGS. 9 and 11. Because the central post 52 of the brace 50 is slidably disposed within channel 48 of the hinge carrier 39 and channel 18 of the handle 12, the user may slide the brace 50 to any position between the fully retracted and fully extended positions, inclusive. By releasing pressure on the tab 36, the spring 38 will bias the tab 36 and reinforcing member 28 about the pin 42 in the hinge joint 43, thus biasing the blade 14 against the cross-member 56.

In addition to changing the location of the brace 50 relative to the blade 14, a user can also rotate the cross-member 56 of the brace 50 in order to selectively position any one of contact surfaces 56*a*, 56*b*, or 56*c* against the blade 14. In embodiments where each of contact surfaces 56*a*, 56*b*, and 56*c* define different profiles, the knife 10 and blade 14 are thereby adjustable to impart differing profiles to the blade 14. Further, in embodiments where knobs or bumps 72 are provided on one or more of contact surfaces 56*a*, 56*b*, or 56*c*, the knobs 72 assist in breaking the surface tension between the contact surface and the blade 14 in the event that some drywall compound overflows or is splashed on that interface. In alternative embodiments, surface relief other than knobs or bumps 72 may be used on one or more of contact surfaces 56*a*, 56*b*, or 56*c* to achieve the same purpose.

There are numerous alternative embodiments contemplated for the knife 10. In one alternative embodiment, the brace 50 and cross-member 56 may be fixed in an extended position, and the hinge joint 43 and spring 38 may be omitted. In such an embodiment, the blade 14 may be sufficiently flexible such that the cross-member 56 may be selectively rotated against a fixed, biased position of the blade 14 against the cross-member 52. In another embodiment, a structure different than a central post 52 may be used to position the cross-member 56 in either a fixed configuration or in a selectively retractable configuration relative to the blade 14. In other embodiments, the cross-member 56 may define one or more contact surfaces defining one or more profiles, and in embodiments where the cross-member 56 defines more than one contact surfaces defining more than one profile, the cross-member 56 may be selectively positionable between the different contact surfaces. In these embodiments, there is no theoretical limit to the number of different profiles that may be so defined.

While the knife 10 has been described in reference to some exemplary embodiments, these embodiments are not limiting and are not necessarily exclusive of each other, and it is contemplated that particular features of various embodiments may be omitted or combined for use with features of other embodiments while remaining within the scope of the invention.

I claim:

1. A drywall knife, comprising:

a handle;

a channel disposed within the handle;

a substantially planar, flexible blade attached to the handle;

a T-shaped brace having a central post and a cross-member wherein the central post is slidably disposed within the channel of the handle and wherein the cross-member defines at least one profile;

wherein the blade is biased to rest against the cross-member such that the cross-member substantially imparts a profile to the blade.

2. The knife of claim 1, further comprising:

the profile imparted to the blade being substantially non-linear.

3. The knife of claim 2, further comprising:

the profile imparted to the blade being substantially arcuate.

4. The knife of claim 1, further comprising:

the cross-member defining at least two profiles.

5. The knife of claim 4, further comprising:

the cross-member positionable to substantially impart different profiles selectively to the blade.

6. The knife of claim 1, further comprising:

the cross-member defining knobby contact surfaces contactable with the blade.

7. The knife of claim 1, further comprising:

the blade being hingedly attached to the handle.

8. The knife of claim 1, further comprising:

a tab attached to the blade.

9. The knife of claim 8, further comprising:

a spring disposed between the tab and the handle.

10. A drywall knife, comprising:

a handle;

a channel disposed within the handle;

a substantially planar, flexible blade hingedly attached to the handle;

a retractable T-shaped brace having a central post and a cross-member wherein the central post is slidably disposed within the channel of the handle and wherein the cross-member defines two or more substantially non-linear profiles;

wherein the blade is biased to rest against the cross-member such that the cross-member substantially imparts one of two or more substantially arcuate profiles to the blade.

11. The knife of claim 10, further comprising:

the cross-member defining three substantially non-linear profiles.

* * * * *